US011767145B2

(12) United States Patent
Fernandes De Carvalho et al.

(10) Patent No.: US 11,767,145 B2
(45) Date of Patent: Sep. 26, 2023

(54) PACKAGING UNIT

(71) Applicant: MELITTA SINGLE PORTIONS GMBH & CO. KG, Minden (DE)

(72) Inventors: Kerstin Fernandes De Carvalho, Bielefeld (DE); Jan Pahnke, Minden (DE); Gerold Schandl, Minden (DE); Holger Feldmann, Willich (DE)

(73) Assignee: MELITTA SINGLE PORTIONS GMBH & CO. KG, Minden (DE)

( * ) Notice: Subject to any disclaimer, the term of this patent is extended or adjusted under 35 U.S.C. 154(b) by 325 days.

(21) Appl. No.: 16/959,118

(22) PCT Filed: Jan. 22, 2019

(86) PCT No.: PCT/EP2019/051524
§ 371 (c)(1),
(2) Date: Jun. 29, 2020

(87) PCT Pub. No.: WO2019/141873
PCT Pub. Date: Jul. 25, 2019

(65) Prior Publication Data

US 2020/0331655 A1 Oct. 22, 2020

(30) Foreign Application Priority Data

Jan. 22, 2018 (DE) ..... 102018101336.1

(51) Int. Cl.
*B65D 5/52* (2006.01)
*B65D 5/02* (2006.01)
(Continued)

(52) U.S. Cl.
CPC ..... *B65D 5/5286* (2013.01); *B65D 5/029* (2013.01); *B65D 71/0029* (2013.01); *B65D 85/8043* (2013.01)

(58) Field of Classification Search
CPC ..... B65D 85/8043; B65D 71/0029; B65D 5/029; B65D 5/5286; B65D 2571/0066;
(Continued)

(56) References Cited

U.S. PATENT DOCUMENTS 3,462,020 A 8/1969 Hall
3,901,389 A 8/1975 Belokin, Jr.
(Continued)

FOREIGN PATENT DOCUMENTS

DE 1269877 B 6/1968
DE 4309584 A1 9/1994
(Continued)

OTHER PUBLICATIONS

German Search Report in corresponding German Patent Application No. 10 2018 101 336.1, dated Aug. 13, 2018, 13 pages with English Google translate.

(Continued)

*Primary Examiner* — Christopher R Demeree
(74) *Attorney, Agent, or Firm* — FisherBroyles, LLP; Robert Kinberg

(57) ABSTRACT

A packaging unit for portioned packaging for the production of drinks, includes a carrier having multiple strips arranged at an angle to one another and on which respective recesses are formed for introducing a respective portioned packaging. The carrier has a tubular shape and the recesses of two neighboring strips are arranged in an offset to one another in a longitudinal direction of the strips. In this way, the portioned packaging can be arranged in a protected manner and in an efficient orientation in the packaging unit.

13 Claims, 6 Drawing Sheets

(51) Int. Cl.
*B65D 71/60* (2006.01)
*B65D 85/804* (2006.01)

(58) Field of Classification Search
CPC .... B65D 11/00; B65D 71/004; B32B 2439/70
USPC ..... 426/108; 229/115, 904, 120.15; 206/194, 756; 211/73, 149; 220/520
See application file for complete search history.

(56) References Cited

U.S. PATENT DOCUMENTS

| | | | | | |
|---|---|---|---|---|---|
| 4,799,590 | A | | 1/1989 | Furman | |
| D305,729 | S | * | 1/1990 | Bridel | D9/756 |
| 5,050,739 | A | | 9/1991 | Hannan et al. | |
| D351,555 | S | * | 10/1994 | Blott | D9/750 |
| 5,676,274 | A | * | 10/1997 | Green | B25H 3/023 220/520 |
| 5,839,590 | A | * | 11/1998 | Weiner | B65D 5/008 229/116 |
| 6,253,920 | B1 | * | 7/2001 | Kallgren | B65D 75/527 206/532 |
| 6,269,961 | B1 | * | 8/2001 | Porcelli | A47F 5/112 211/73 |
| 7,905,365 | B2 | * | 3/2011 | Virvo | A47F 5/116 211/73 |
| 7,954,655 | B2 | * | 6/2011 | Virvo | G09F 1/10 211/150 |
| 8,640,889 | B2 | * | 2/2014 | Gasper | A47F 5/0823 211/74 |
| 11,122,916 | B2 | * | 9/2021 | Gregory | F16B 12/22 |
| 11,299,314 | B2 | * | 4/2022 | Dammers | B65D 5/064 |
| 2017/0354273 | A1 | | 12/2017 | Wilke | |

FOREIGN PATENT DOCUMENTS

| | | | |
|---|---|---|---|
| EP | 0461929 | A1 | 12/1991 |
| FR | 1342248 | A | 11/1963 |
| JP | S54139582 | U | 9/1979 |
| JP | H04201882 | A | 7/1992 |
| JP | 2011084295 | A | 4/2011 |
| WO | 2006091958 | A1 | 8/2006 |
| WO | 2010060613 | A1 | 6/2010 |

OTHER PUBLICATIONS

German Search Report in corresponding German Patent Application No. 10 2018 101 336.1, dated Aug. 13, 2018, 6 pages.

International Search Report in corresponding International Patent Application No. PCT/EP2019/051524, dated Mar. 25, 2019, 2 pages in English.

Japanese Office Action in corresponding Japanese Patent Application No. 2020-540398, English Translation, dated Oct. 26, 2022, 3 pages.

* cited by examiner

PACKAGING UNIT

CROSS-REFERENCE TO RELATED APPLICATIONS

This application is a U.S. National Stage of International Patent Application No. PCT/EP2019/051524 filed on Jan. 22, 2019, which claims benefit of German Patent Application No. 10 2018 101 336.1 filed Jan. 22, 2018.

TECHNICAL FIELD

The present invention relates to a packaging unit for portion packs for the production of beverages, comprising a carrier having multiple strips arranged at an angle to one another and on each of which receptacles are formed for the insertion of a respective portion pack.

BACKGROUND OF THE INVENTION

It is well known that portion packs, for example for the preparation of coffee, should be provided in a larger packaging unit, for example a bag made of film material, which forms a barrier protection and thus preserves the aroma of ground coffee in the portion packs. However, when the user opens such a bag, the ground coffee in the individual portion packs loses its aroma, which affects the quality of the beverage after a certain time. In addition, sensitive portion packs are often severely deformed in a bag, which can limit their functionality.

SUMMARY OF THE INVENTION

It is therefore an object of the present invention to create a packaging unit with improved protection for portion packs.

The above and other objects are solved according to one embodiment which provides for a packaging unit that comprises a carrier in which individual receptacles are formed for the insertion of one portion pack each, wherein the carrier comprises several strips arranged at an angle to one another. The carrier is shaped in a tubular manner, wherein the receptacles of two adjacent strips are arranged in an offset manner in the longitudinal direction of the strips, so that the volume of the carrier can be used optimally, in particular, tapering portion packs can be positioned compactly in an interior of the carrier. The carrier offers protection against damage, while the packaging unit can also be easily stacked and transported.

According to an embodiment, two edge strips of the carrier are joined together. In this way, a flat material with a large number of receptacles can first be assembled into a tube. The carrier is preferably formed triangular in cross-section, wherein two strips are fitted with receptacles for portion packs and the third strip is formed by the interconnected edge strips. For optimum use of space, the edge strip, i.e. the third strip, is also preferably provided with receptacles for portion packs. Two of the strips can be symmetrically fitted with receptacles for portion packs and a third strip can have receptacles offset longitudinally to the other two strips to achieve optimum volume utilization. In a further embodiment, the receptacles on all strips are offset lengthwise to guarantee ideal use of space.

For exact positioning of the portion packs, each receptacle can be pot-shaped, bowl-shaped, cone-shaped, shaped as a truncated cone, pyramid-shaped or shaped in the form of a truncated pyramid. Particularly in the case of tapered or conical portion packs, the receptacles can hold the portion pack securely, and the internal volume of the carrier is efficiently utilized by the staggered arrangement of the receptacles and portion packs. In addition, damage to the portion packs and the receptacles can be avoided if an often sensitive tip or underside of the receptacle is accommodated within the tubular carrier. The tip or underside may be spaced from a wall portion of the carrier that surrounds the tip or underside.

In another embodiment, several tubular carriers are connected to each other to form a packaging unit. The individual carriers with a triangular cross-section can be combined to form square, rectangular or diamond-shaped beams or other larger packaging units.

For an environmentally friendly production of the packaging unit, the carrier may be made of paper, cardboard or cast fiber, or a thin plastic material can be used, which may be thermoformed. For a long retention of the aroma of the extraction material in the portion packs, the carrier may have a barrier layer preferably applied to the receiving side. If the carrier is made of paper, a thin film lamination may be provided, for example, to act as a barrier. A barrier layer made of sustainable materials such as wax or micro/nanofibrillated cellulose is particularly advantageous. In addition, one top side of the portion packs may be covered with a further protective film, which may be connected to the other barrier layer by a detachable connection, so that comprehensive barrier protection is provided.

The portion packs in the carrier preferably contain an extraction material, in particular ground coffee or tea, so that the portion packs can be used for beverage production in a suitable machine.

BRIEF DESCRIPTION OF THE DRAWINGS

The invention is explained in more detail below based on several embodiment examples with reference to the attached drawings, wherein.

DETAILED DESCRIPTION OF THE INVENTION

Figure 1:
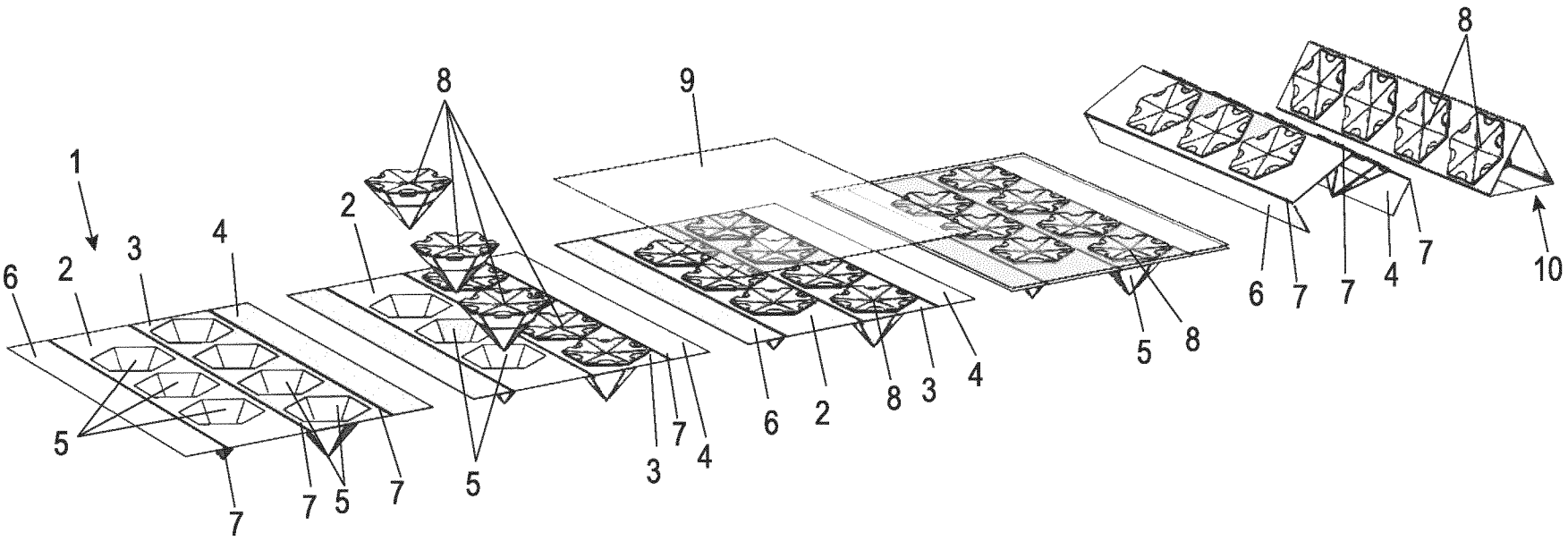
FIG. 1 shows a view of a process for producing a packaging unit in accordance with the invention.

A carrier 1 consists of a substantially plate-shaped material, for example of paper, cardboard, cast fiber or a plastic on which several recesses are formed in the form of receptacles 5. The carrier 1 comprises two strips 2 and 3, which are connected to each other by a folding edge 7. In addition, strip 2 is connected on the side facing away from strip 3 to an edge strip 6 via a folding edge 7, and strip 3 is connected on the side facing away from strip 2 to an edge strip 4 via a folding edge 7. The receptacles 5 can be pot-shaped, bowl-shaped, cone-shaped, shaped as a truncated cone, pyramid-shaped or shaped in the form of a truncated pyramid and are used to accommodate portion packs, for example for preparing coffee or tea.

In order to form a barrier protection, the carrier 1 can be formed with a barrier protection on its upper side and on the inside of the receptacles 5, for example coated with a thin plastic or metal layer. A barrier layer made of sustainable materials such as wax or micro/nanofibrillated cellulose is particularly advantageous. The coating can consist of one or more layers. Alternatively, an appropriate barrier protection can also be integrated into the material of carrier 1.

In a first step, carrier 1 is filled with portion packs 8, which are made of a filter material, for example filter paper, and contain an extraction material, such as ground coffee. In this example, the portion packs 8 are essentially pyramid-shaped and have a tip protruding into receptacle 5. The portion packs 8 are positively secured in the receptacles 5 against displacement. Portion packs 8 can be inserted in one plane and in the same orientation, which greatly simplifies a packaging system.

After inserting the portion pack 8, a protective foil 9 is optionally provided, which is placed on the top of the portion pack 8 and covers it. The protective film 9 is then joined to the material of the carrier 1, in particular sealed, glued or welded. In this way, the portion packs 8 are protected and arranged between the protective film 9 and the carrier 1.

Additional elements can be attached to the protective film 9, for example to exert pressure on the portion pack 8. These elements can be made of additional material, such as foam, cardboard or corrugated cardboard, or they can be formed by the film itself, for example in the form of air cushions as in the case of bubble wrap.

The carrier 1 filled in this way can now be folded along the folding edges 7, wherein the edge strips 4 and 6 are joined together. This can be done, for example, by mechanical interlocking, but especially by gluing or welding. This produces a tubular carrier 1 with a triangular cross-section, which forms a packaging unit 10.

The receptacles 5 on strips 2 and 3 are offset in the longitudinal direction of the strips so that a tip of a receptacle 5 on strip 2 projects between two receptacles 5 on the adjacent strip 3. This means that the internal volume of carrier 1 can be used efficiently for portion pack 8.

Figure 2:
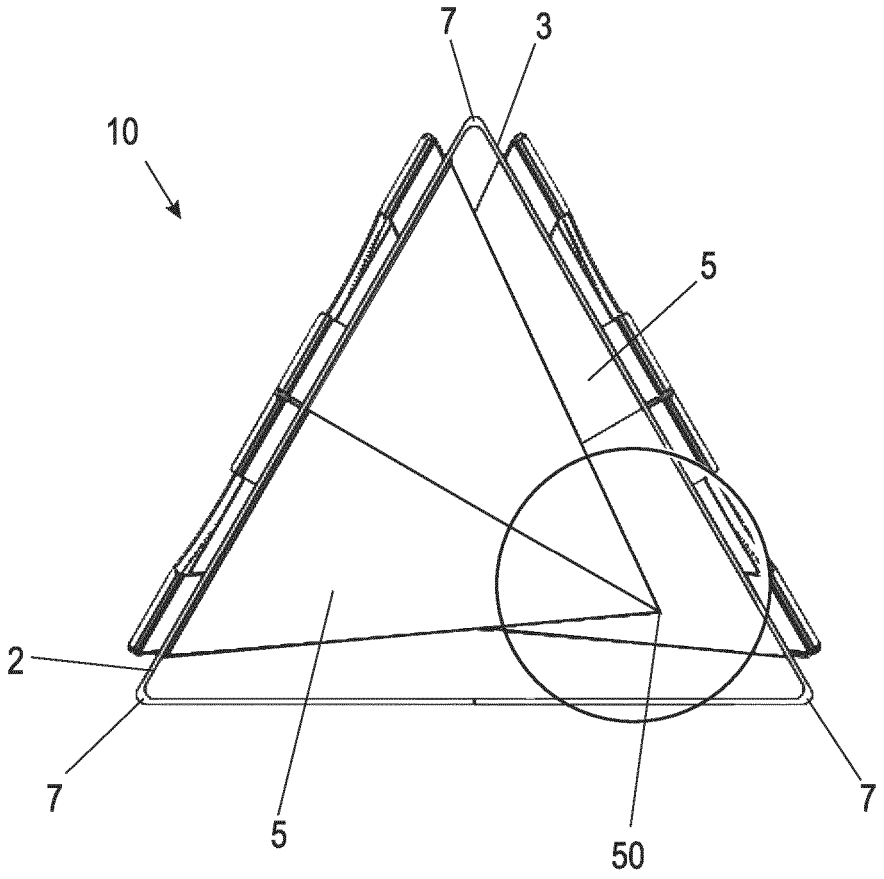
FIG. 2 shows a sectional view through the packaging unit of FIG. 1.

FIG. 2 shows a sectional view through packaging unit 10 with carrier 1, and it can be seen that the portion packs in the pyramid-shaped receptacles 5 are oriented at an angle to each other at strips 2 and 3, preferably at an angle of about 60°. In addition, it can be seen that a tip 50 on a receptacle 5 is positioned at a distance from the carrier, so that protection against damage is provided. The tip 50 is located in the interior space at a distance from a folding edge 7 and a wall section of the carrier. This also makes the manufacturing process robust against commonly occurring tolerances.

Figure 3:
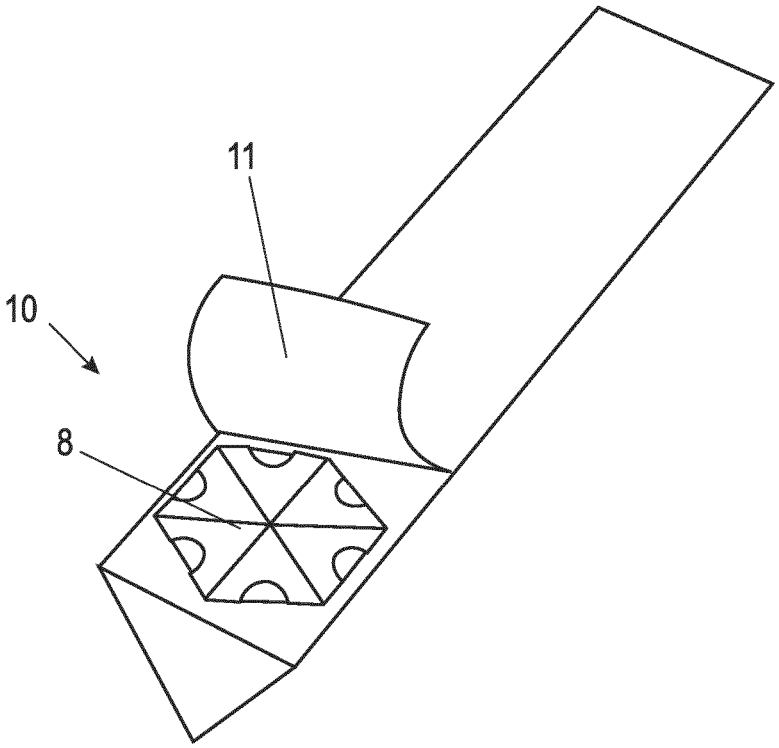
FIG. 3 shows a perspective view of a packaging unit as it is opened.

FIG. 3 shows packaging unit 10 when a portion pack 8 is removed. Packaging unit 10 may be covered in the area of the portion packs 8 with a further protective film 11, which is in the form of a strip and can be removed from the top of a strip 2. In a particularly advantageous embodiment, the protective film 11 is bonded around each individual portion pack 8 to the carrier 1 or the barrier layer of the carrier. This allows the user to remove one portion pack 8 individually from the receptacle 5, while the other portion packs 8 are still protected in packaging unit 10, in particular by barrier protection provided by the films present. The protective film 11 may be formed on the inside by the protective film 9 shown in FIG. 1 and is still decoratively coated or printed on the outside. Appropriate perforations may be made to facilitate removal of the protective films. In the example shown, the film 11 is peeled off lengthwise from packaging unit 10, but it can of course also be peeled off crosswise or diagonally.

Figure 4:
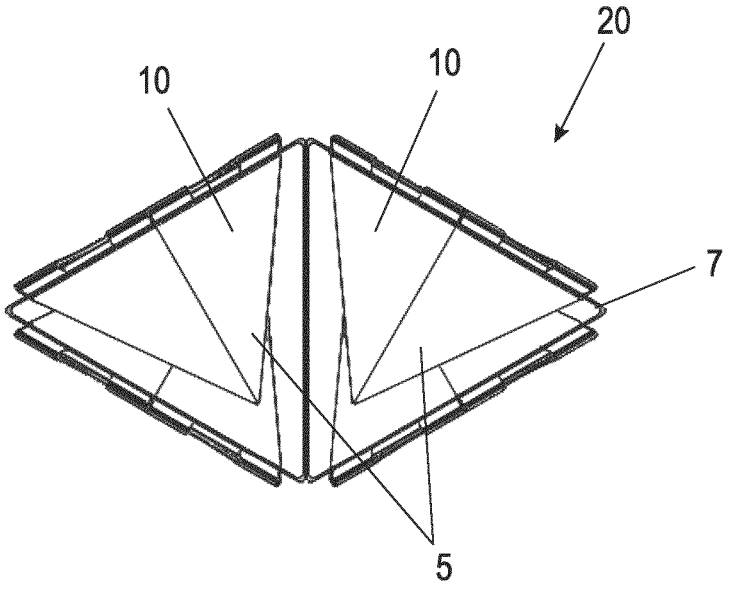
FIG. 4 shows a sectional view of an assembled packaging unit.

FIG. 4 shows a modified packaging unit 20, which is composed of two smaller packaging units 10. The two packaging units 10 are held together, in particular glued together, by their sides which are not provided with receptacles 5. As a result, packaging unit 20 is diamond-shaped in cross-section and comprises four sides on which portion packs 8 are provided.

In the embodiment example shown, seven portion packs 8 are accommodated on a packaging unit 10. It is of course also possible to have fewer or more receptacles 5 and portion packs 8 on a packaging unit 10. Each strip 2 or 3 preferably contains between two and eight receptacles 5, preferably between three and five receptacles 5.

Figure 5A:
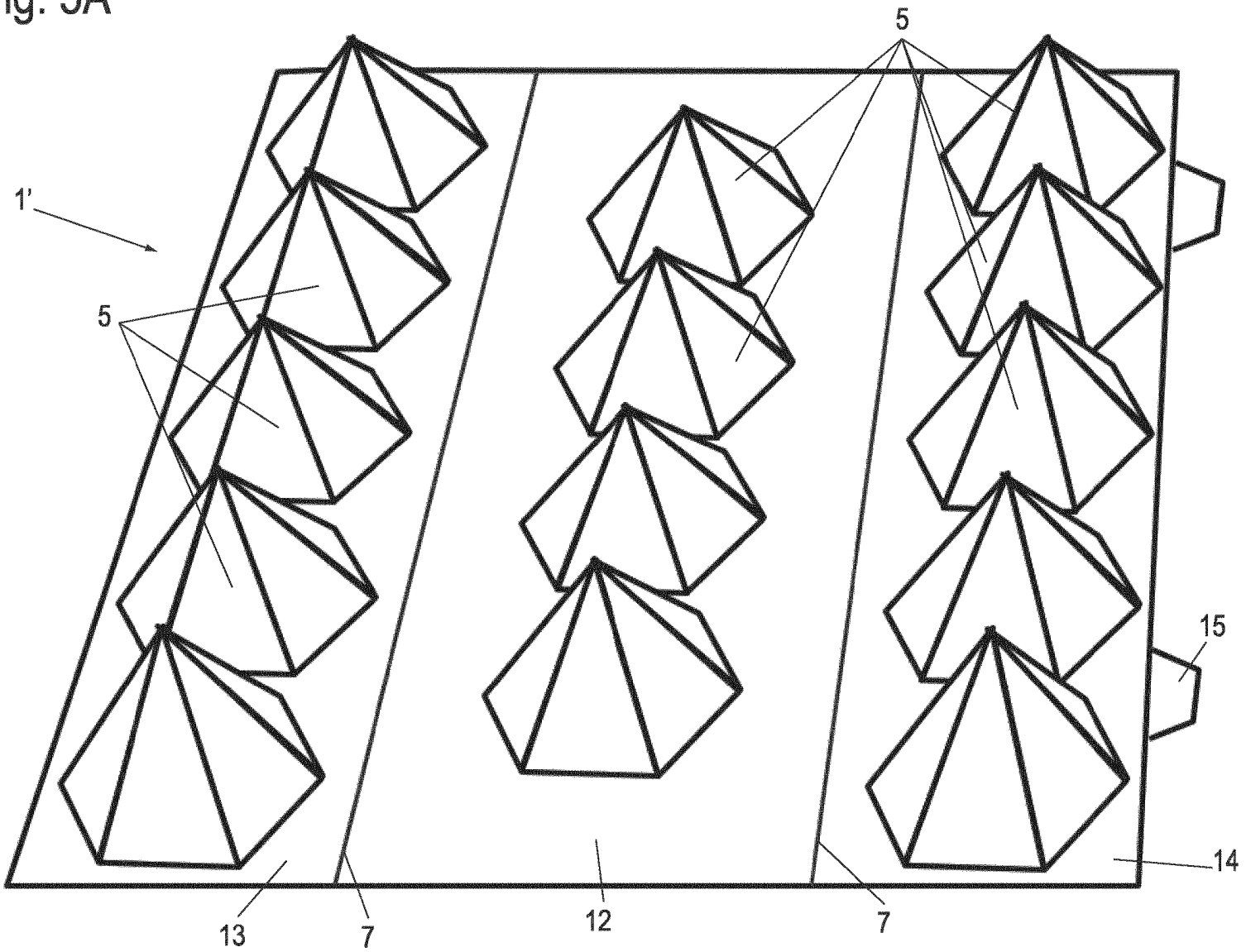
FIGS. 5A and 5B show two views of a blank of a modified packaging unit.
Figure 5B:
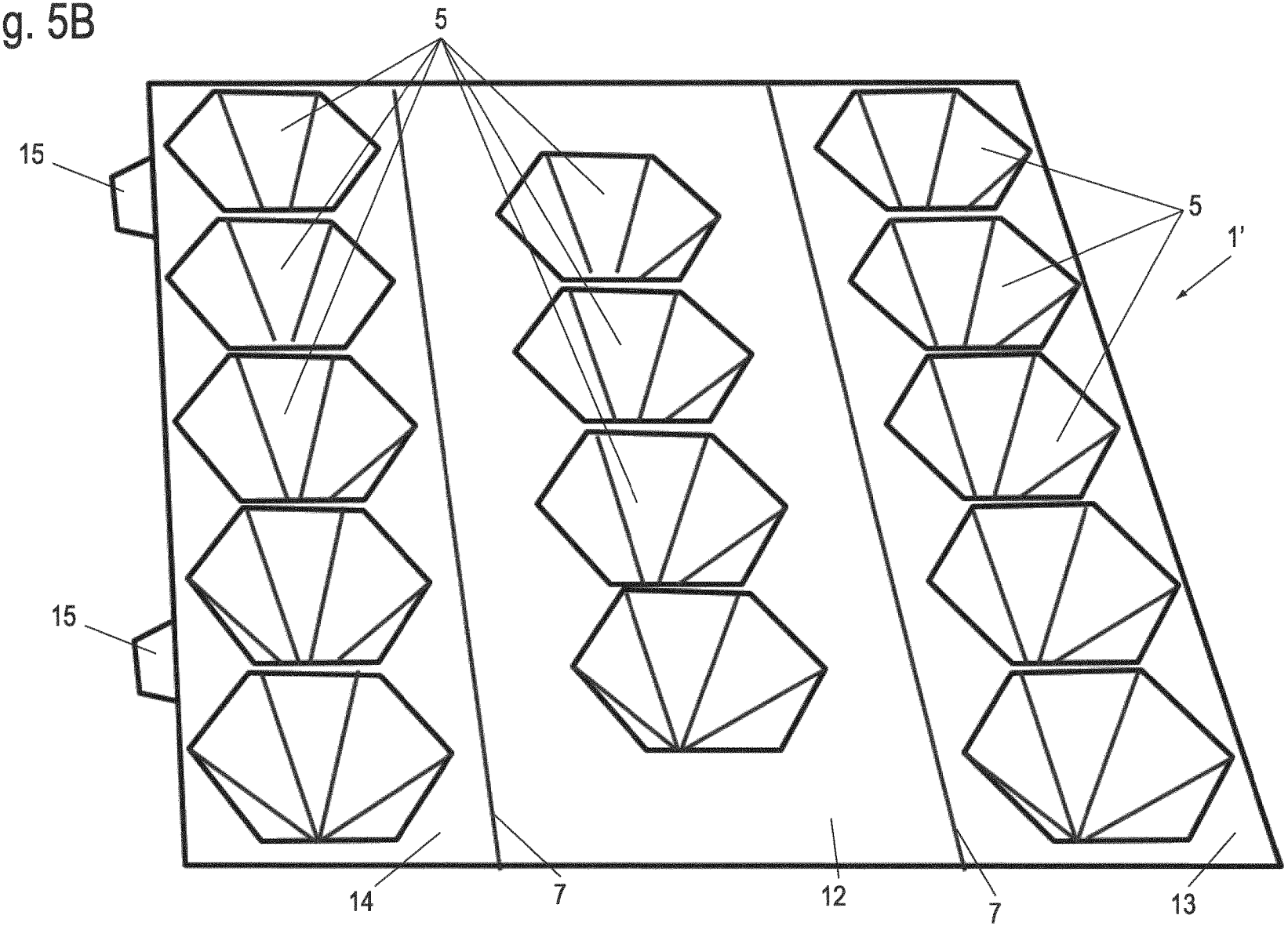

FIGS. 5A and 5B show a blank of a modified packaging unit with a carrier 1'. The carrier 1' comprises three strips 12, 13 and 14, with the middle strip 12 being connected to the two outer strips 13 and 14 in each case by a folding edge 7. The middle strip 12 has four receptacles 5 for one portion pack 8 each and the two outer strips 13 and 14 have five receptacles 5 for one portion pack 8 each. The middle strip 12 is slightly wider than the two outer strips 13 and 14.

At least one protruding edge section 15 is provided on the side of strip 14 facing away from the middle strip 12. When the blank is folded along the two folding edges 7 to form a tube with a triangular cross-section, the receptacles 5 protrude into the tube. To fix this shape, the edge sections 15 on the strip 14 can be joined to the outer strip 13, preferably by gluing or stamping. Alternatively, or in addition, mechanical fixing can also be achieved by inserting the edge sections 15 into a slot-shaped receptacle on the strip 13.

Instead of the two edge sections 15 on the strip 14, there may also be a single edge section 15 or more than two edge sections 15.

The volume of all receptacles 5 with respect to the volume of the triangular tubular carrier 1' is preferably at least 25%, and in particular between 30% and 50%.

Figure 6:
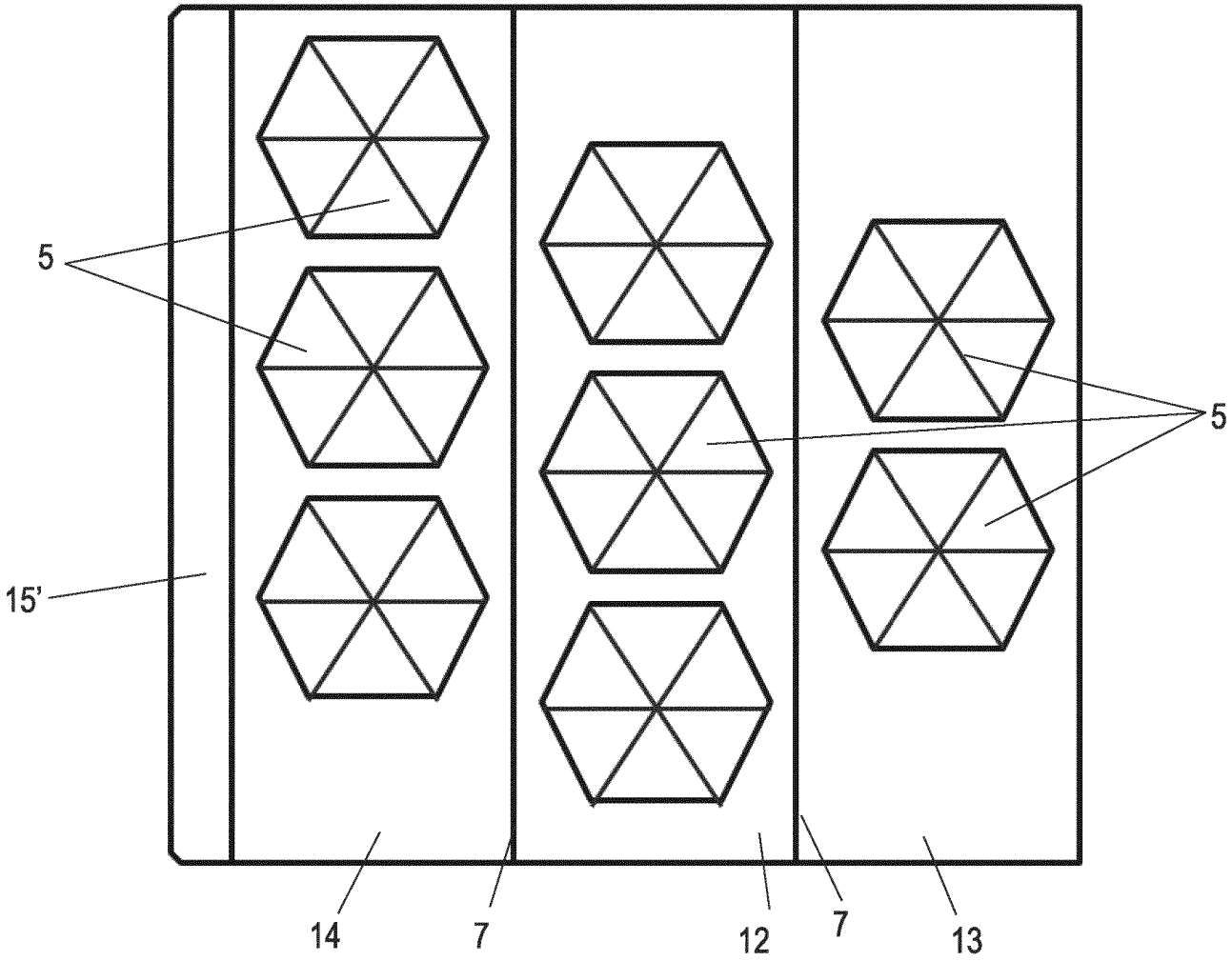
FIG. 6 shows a view of another modified packaging unit.

FIG. 6 shows a view of a blank of a modified packaging unit with three strips 12, 13 and 14, each connected to each other by folding edges 7. Instead of several edge sections 15, one strip 14 is provided with a strip-shaped edge section 15', which is joined to the other outer strip 13, preferably by gluing. In this embodiment, the receptacles 5 on all strips 12, 13 and 14 are arranged offset to each other in the longitudinal direction of the same in order to enable an ideal use of space.

The invention claimed is:

1. A packaging unit for portion packs for a production of beverages, comprising a carrier having a plurality of strips arranged at an angle to one another, wherein each strip includes receptacles formed therein for the insertion of a respective portion pack and the packaging unit additionally includes a barrier including a plurality of individual layers arranged on the carrier for enclosing a respective one of the portion packs in the receptacles of the packaging unit, and wherein the carrier has a tubular shape and a triangular cross-section, the receptacles of two adjacent strips are arranged offset to one another in a longitudinal direction of the strips, and each receptacle is one of pot-shaped, bowl-shaped, cone-shaped, shaped as a truncated cone, pyramid-shaped and shaped as a truncated pyramid to match a corresponding shape of a respective portion pack to be inserted into the packaging unit.

2. The packaging unit according to claim 1, wherein the carrier comprises one of: a) two edge strips each having one edge connected to an edge of one of the plurality of strips and an opposite edge connected to the opposite edge of the other edge strip and b) at least one edge section of one strip connected to another one of the plurality of strips.

3. The packaging unit according to claim 1, wherein each receptacle has an underside having a tip that is accommodated within the tubular shape of the carrier.

4. The packaging unit according to claim 1, wherein each strip has between two and eight receptacles.

5. The packaging unit according to claim 1, wherein the carrier comprises a plurality of tubular carriers connected to one another to form the packaging unit.

6. The packaging unit according to claim 1, wherein the carrier comprises one of paper, cardboard, cast fiber and thermoformed plastic sheet.

7. The packaging unit according to claim 1, further including a protective film arranged outside a top side of the portion packs when the portion packs are in the respective receptacles of one of the strips.

8. The packaging unit according to claim 7, wherein the protective film, together with one of the carriers and the barrier layer of the one carrier, tightly encloses each portion pack individually.

9. The packaging unit according to claim 7, wherein the protective film is adapted to be peelable off in segments transversely or longitudinally to a longitudinal direction of the packaging unit.

10. The packaging unit according to one claim 1, wherein the plurality of strips, each with receptacles, comprises three strips connected to one another via folding edges to form the triangular tubular carrier.

11. The packaging unit according to claim 10, wherein the three strips include a middle strip between two outer strips, and the middle strip has one receptacle less than the two outer strips.

12. The packaging unit according to claim 1 forming a combination with the portion packs, each containing an extraction material and arranged in the respective receptacles of the carrier.

13. A packaging unit for portion packs for a production of beverages, comprising: a carrier having a plurality of strips arranged at an angle to one another, wherein each strip includes receptacles formed therein for the insertion of a respective portion pack and the packaging unit additionally includes a barrier including a plurality of individual layers arranged on the carrier for enclosing a respective one of the portion packs in the receptacles of the packaging unit, wherein the carrier has a tubular shape, the receptacles of two adjacent strips are arranged offset to one another in a longitudinal direction of the strips, each receptacle is one of pot-shaped, bowl-shaped, cone-shaped, shaped as a truncated cone, pyramid-shaped and shaped as a truncated pyramid to match a corresponding shape of a respective portion pack to be inserted into the packaging unit, and wherein all the receptacles together have a volume that is at least 25% of the total volume of the tubular carrier.

* * * * *